US005803398A

United States Patent [19]

May et al.

[11] Patent Number: 5,803,398

[45] Date of Patent: Sep. 8, 1998

[54] MULTIPLE DUROMETER PRESSURE ROLLER

[75] Inventors: Daniel R. May, West Henrietta; Kevin A. Cole, Ontario; Sharon A. Guzman, Kent; Scott W. Tang, Rochester, all of N.Y.

[73] Assignee: Eastman Kodak Company, Rochester, N.Y.

[21] Appl. No.: 613,274

[22] Filed: Mar. 8, 1996

[51] Int. Cl.[6] ..... B65H 18/26; B65H 18/14

[52] U.S. Cl. ..... 242/547; 242/541

[58] Field of Search ..... 242/547, 541, 242/541.4

[56] References Cited

U.S. PATENT DOCUMENTS

| | | | |
|---|---|---|---|
| 2,059,871 | 11/1936 | Honeyman, Jr. | 242/541 X |
| 2,985,398 | 5/1961 | Rockstrom et al. | 242/530.4 |
| 3,236,431 | 2/1966 | Foreman | 226/190 |
| 3,491,655 | 1/1970 | Brafford | 93/1 |
| 3,499,998 | 3/1970 | Tanigawa et al. | 179/100.2 |
| 3,622,059 | 11/1971 | Savela | 226/190 |
| 3,659,797 | 5/1972 | Coy | 226/186 X |
| 3,737,030 | 6/1973 | Stewart | 206/59 |
| 3,779,475 | 12/1973 | Plevin | 242/541 X |
| 4,326,659 | 4/1982 | Sato | 226/190 |
| 4,343,440 | 8/1982 | Engl | 242/547 |
| 4,877,196 | 10/1989 | Heymanns | 242/541.5 |
| 4,934,622 | 6/1990 | Hakiel | 242/613 |
| 5,039,023 | 8/1991 | Hagens et al. | 242/547 |
| 5,153,663 | 10/1992 | Bober et al. | 355/319 |
| 5,195,430 | 3/1993 | Rise | 100/168 |

FOREIGN PATENT DOCUMENTS

| | | |
|---|---|---|
| 521681 | 1/1993 | European Pat. Off. . |
| 169016 | 2/1904 | Germany . |
| 4023235 | 1/1992 | Germany . |
| 7267451 | 10/1995 | Japan . |
| 93/15009 | 8/1993 | WIPO . |

*Primary Examiner*—John Q. Nguyen
*Attorney, Agent, or Firm*—Susan L. Parulski

[57] ABSTRACT

A multiple durometer pressure roller for winding a web of deformable material onto a core, particularly for reducing air entrainment in the wound roll. The pressure roller includes a rigid cylindrical shaft, a resilient central sleeve supported by the shaft, and two end sleeves supported at each end of the resilient sleeve. The end sleeves have a lower durometer than the resilient sleeve. In a preferred embodiment, the end sleeves and the resilient sleeve are covered by an outer cover having a higher durometer.

11 Claims, 7 Drawing Sheets

MULTIPLE DUROMETER PRESSURE ROLLER

FIELD OF THE INVENTION

The present invention relates to a process for winding film web onto a core. More particularly, the present invention provides a method and apparatus for winding web material in which air entrainment is reduced and the wound roll is free of defects.

BACKGROUND OF THE INVENTION

Winding is a vital step in the process of making and converting web material. If the web is not wound properly, defects such as scratches can result which make the web unsuitable for finished product, particularly with photographic film and paper. A web must be wound properly so that it can be stored without deterioration; if not, the web may be unsuitable for saleable product. The total loss of a wound roll can be very costly.

The entrainment of air while winding can cause defects in a wound roll. Air entrainment occurs when a layer of air moving with the web becomes wound into the roll. Air entrainment can occur at any web speed but is a particular concern when winding at high speeds, for example, 100 feet per minute or greater. Generally, air entrainment increases as roll radius, air viscosity, and web velocity increase, while air entrainment generally decreases as web tension increases. Other factors affecting the amount of entrained air are web temperature, surface roughness, planarity, and thickness variation.

If the amount of entrained air is substantial, a lap of wound web may not make contact with a previous lap, and the newly wound lap may shift or move relative to the previous lap in a direction that is parallel to the axis of the core (generally known as surface skidding), especially as the diameter of the wound roll increases. Entrained air makes the roll unstable, causing the roll to shift or move dramatically relative to the core. For coated webs, such as emulsion coated photographic webs, shifting can cause scratching of the coating, resulting in unsalable or defective product. Additionally, shifting may cause the web edges to contact the winding machinery, possibly resulting in severe damage to the roll such that it would be unsuitable for subsequent processes.

Air entrainment may also result in another winding problem called cinching. Cinching is the relative motion of one lap to another in the circumferential direction. Cinching occurs when in-roll pressure and, therefore, the frictional force, is reduced due to the air entrainment. The torque used in winding the roll eventually overcomes the reduced frictional force between the two laps and relative motion occurs. Scratching of the web and/or film emulsions can result, as can axial shifting.

During storage, entrained air within a roll will eventually leak out of the roll. If the roll is stored with the core axis in a vertical orientation, the roll can loosen and shift downward due to gravity. The lower web edges can buckle, causing a defect referred to as edge cockle. If the roll is stored with the core axis oriented horizontally, air will still leak out and the roll may sag in the center due to gravity, resulting in permanent stretching deformation. In both cases, the roll may not be suitable for unwinding in subsequent processes.

One method for reducing air entrainment is to carry out the entire winding process in a vacuum chamber. However, such a solution would be extremely costly and is not realistic.

Another method for reducing air entrainment is to increase the winding tension. However, winding machines are generally limited by drives to a maximum given amount of tension, which may not be sufficient to reduce air entrainment at high speeds for quality winding.

Another method for reducing the amount of entrained air is to use a contact roller or pressure roller in contact with the roll being wound, to squeeze out air as the roll is being wound. With such a method, the pressure roller must accommodate features of the web material, such as variations in thickness, while still providing contact with the center of the roll to reduce air entrainment. In addition, it is preferred to have a pressure roller with a length substantially equal to the width of the web material. As illustrated in FIG. 1, a contact roller or pressure roller 10 is in contact with a roll 11 as it is being wound. A nip, shown generally as nip 12, is formed between pressure roller 10 and winding roll 11, and sufficient force is applied to squeeze out the air at nip 12 when web material 13 is wound onto core 14. The use of pressure roller 10 increases the wound-in tension of the roll, allowing a reduced amount of air to be entrained during the winding process. Generally, pressure rollers 10 have a hard metal surface, such as stainless steel or aluminum, or have a single resilient covering with the hardness of approximately 50 to 70 durometer Shore A.

Pressure roller 10 may be applied using various configurations. For example, in pressure roller assisted center winding, a force F is applied to the pressure roller and the core is driven about a fixed center while the pressure roller is idling on a pivot or slide; the pressure roller rotates at the speed of the moving web due to frictional force applied to the pressure roller by the moving web. Similarly, in surface winding, the core can idle on a fixed center with the pressure roller being driven about pivot or slide. In a further configuration referred to as reel winding, the core idles on a non-fixed center position with the pressure roller driven about a fixed center, and the force F is applied to the core. In the dual driven winding configuration, the core and pressure roller are both driven at a substantially equal surface speed, or the core is driven while the pressure roller is driven at a surface speed slower than the core. With double drum winding, the roll is cradled between two driven pressure rollers, and the core is idling.

The widthwise thickness variation of web 13 can affect the winding of a roll. Typically, there is some variation in widthwise thickness, particularly with web materials such as cellulose triacetate, polyethylene terephthalate, or polyethylene naphthalate. As illustrated in FIG. 2, if such a thickness variation persists in the lengthwise direction of the web, known as a gage band 16, then, when the web is wound onto a core, gage band 16 lies upon itself as subsequent laps of web are wound. This produces a hard thick band or streak of extremely high localized pressure, typically known as a hardstreak. A hardstreak may cause detrimental effects to the web such as abrasions, deformations, and chemical and/or physical changes to the web material.

Referring to FIG. 3, U.S. Pat. No. 4,934,622, commonly assigned, and incorporated herein by reference, discloses a method of overcoming the problems of gage bands by knurling 18 the margins of the web material, so that the protuberances produced by the knurling are higher than any gage band likely to be encountered in normal manufacturing. When the knurled web is wound onto a core, the knurled margins overlap, and, it is in this area that the high pressure between adjacent turns is encountered. The buildup of thickness due to the knurled margins is commonly referred to as a knurl tire 20, as illustrated in FIG. 3. The knurl tire 20 of an uncoated web material can typically be as high as 0.125 inches (3.175 mm) above the body of the roll, while knurl tires of a coated web material can typically be as high as 0.0625 inches (1.5875 mm) above the body of the roll. As the roll diameter increases, these heights may increase.

FIG. 4 illustrates a coated web material (that is, web material with one or more layers or coating 22) having knurls 18 and coated margins 24 which are thicker than the remainder of the coated web material. This is referred to as an edgebead 26, and may be magnified when more than one coating is provided or if the knurled margins are coated. An illustration of edgebeading is shown in FIG. 4 where the margins 24 of the coating 22 are thicker than the center portion of the coating. When such thicker coated margins are wound onto a core, hardstreaks may occur, forming an edgebead tire. This is similar to a thin knurl tire, however, the width of a coating edgebead is much less than the width of a knurl. If the thickness of the portion of web material which is coated is of a similar thickness as the knurled edge, the web material will wind on the edgebead, and high localized pressures may result. If the edgebead tire is narrow, it will axially buckle under sufficient pressure, possibly causing the roll to cinch or shift or a combination of the two.

Accordingly, it is preferred that a roll be wound with reduced air entrainment, yet a pressure roller should accommodate existing hardstreaks, knurl tires, and edgebead tires. That is, pressure rollers need to contact hardstreaks, knurl tires and edgebead tires while still providing contact with the center of the roll to reduce air entrainment. In addition, it is preferred to have a pressure roller with a length substantially equal to the width of the web material.

U.S. Pat. No. 5,039,023 discloses a contact roll and two air displacement rollers to squeeze out the air boundary layers during winding. The contact roll and one of the air displacement rollers have a hard smooth surface layer with an average peak-to-valley height Ra of less that 0.4 microns and a Brinell hardness greater than 10 HB 2.5/62.5. Such rollers are expensive to produce and will not contact the entire roll surface in the presence of knurl tires, edgebead tires, or hardstreaks. In addition, contacting hardstreaks with a hard surface, particularly at high speeds, may create even higher localized pressures, resulting in damage to the web.

U.S. Pat. No. 3,622,059 discloses a transport roller including a resilient roller filled with glass spheres that maintain a light and uniform pressure across the nip. Such a roller is believed to be unsuitable for high speed applications, for example, for speeds greater than 1000 feet per minute.

Accordingly, there exists a need for a pressure roller which reduces air entrainment, and accommodates web material having hardstreaks, knurl tires, and edgebead tires. The present invention solves these problems by providing a pressure roller with variable durometer.

SUMMARY OF THE INVENTION

An object of the invention is to provide an apparatus and method for winding web of deformable material on a core which reduces air entrainment.

Another object of the invention is to provide such an apparatus and method which accommodates web material having hardstreaks, knurl tires, and edgebead tires.

Yet another object of the invention is to provide a pressure roller whose surface contacts a winding roll surface in the presence of knurls, edgebeads, or hardstreaks.

Still another object of the invention is to provide such a pressure roller which provides good roll quality and stability, with reduced shifting and cinching.

These objects are given only by way of illustrative examples; thus, other desirable objectives and advantages inherently achieved by the disclosed invention may occur or become apparent to those skilled in the art. The invention is defined by the appended claims.

According to one aspect of the invention, there is provided a method of winding a web of deformable material on a core, the web including first and second margins of a first thickness and a center region disposed intermediate the first and second margins having a second thickness less than the first thickness. The method includes forming a nip between a pressure roller and a core, the pressure roller having a rigid cylindrical shaft and a first, second, and a central portion supported on the shaft, the central portion being disposed intermediate the first and second portions, the first and second portions being made of a material more compliant than the central portion, the nip including a first nip area formed by the core and the first portion, a second nip area formed by the core and the second portion. The first edge of the web is aligned with the first nip area, and the second edge of the web is aligned with the second nip area. As the web is transported through the nip to wind the web on the core, the first and second portions of the pressure roller are deformed to conform to the first and second margins of the web to maintain contact between the center region of the web and the central portion of the pressure roller to reduce air entrainment in the wound roll.

According to another aspect of the invention, there is provided an apparatus for winding a web of deformable material which includes a pressure roller which has a rigid cylindrical shaft, a central resilient sleeve supported at a midpoint on the rigid shaft, a first end sleeve supported on the first end of the rigid shaft, a second end sleeve supported on a second end of the rigid shaft wherein the first and second end sleeves have a durometer less than a durometer of the central resilient sleeve. A core is positioned to form a nip with the pressure roller wherein the web passes through the nip as it is wound onto the core. In a preferred embodiment of the apparatus of the present invention, the pressure roller includes an outer cover covering the first and second end sleeves and the central sleeve.

The present invention provides a multiple durometer pressure roller which reduces air entrainment, and accommodates web material having hardstreaks, knurl tires, and edgebead tires. The pressure roller provides good roll quality and stability at high speeds, with reduced shifting, and cinching.

BRIEF DESCRIPTION OF THE DRAWING

The foregoing and other objects, features, and advantages of the invention will be apparent from the following more particular description of the preferred embodiments of the invention, as illustrated in the accompanying drawings.

FIG. 7(*b*) shows a fourth embodiment of a pressure roller according to the present invention.

DESCRIPTION OF THE PREFERRED EMBODIMENTS

Figure 1:
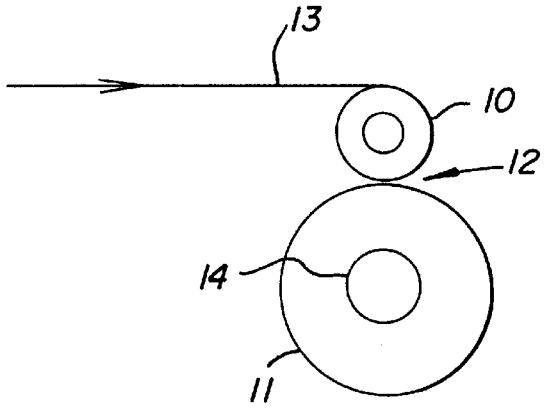
FIG. 1 PRIOR ART
FIG. 1 shows a side view of a core and a pressure roller forming a nip for winding a web of deform able material on a core.
Figure 2:
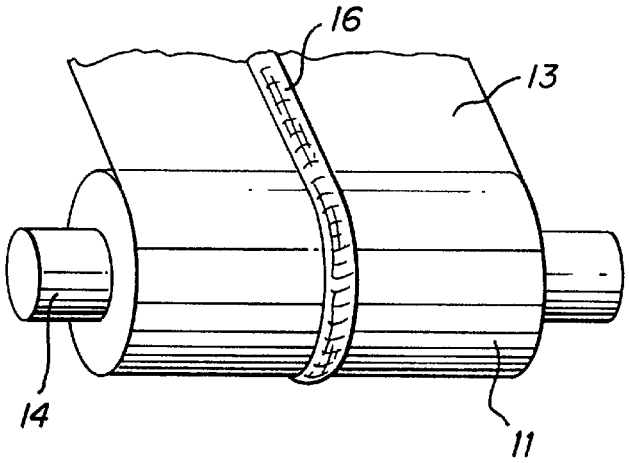
FIG. 2 PRIOR ART
FIG. 2 shows a view of a web having a hardstreak formed on the roll.

The following is a detailed description of the preferred embodiments of the invention, reference being made to the drawings in which the same reference numerals identify the same elements of structure in each of the several figures.

Figure 5:
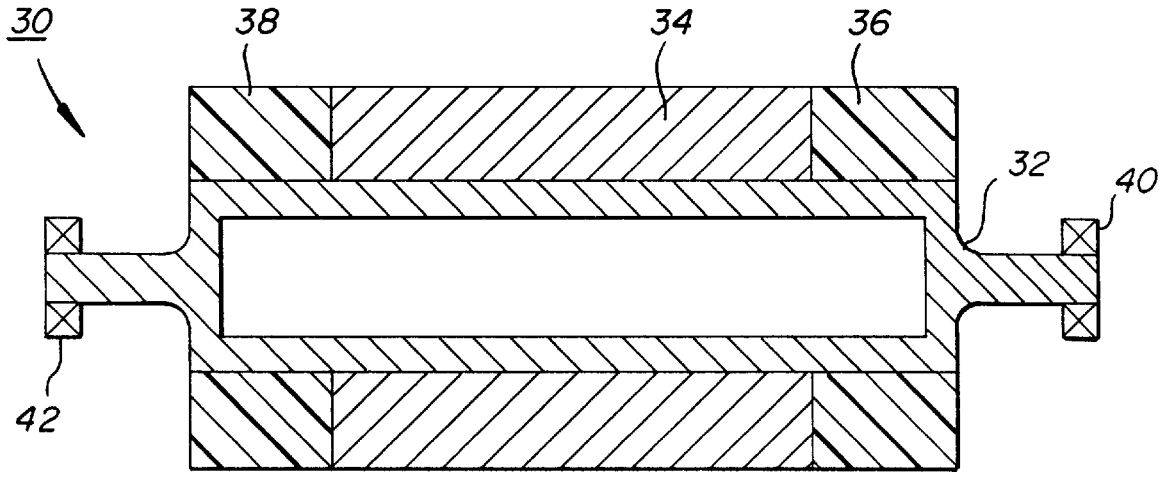
FIG. 5 shows a first embodiment of a pressure roller according to the present invention.

FIG. 5 illustrates a first embodiment of a multiple durometer pressure roller 30 of the present invention. A rigid member 32 is made of metal, or other rigid material able to withstand high stresses without bending deflections. In the present embodiment, the external surface of member 32 is cylindrical. The entire length of a central resilient sleeve 34 is supported by member 32. Sleeve 34 is attached to member 32 by means known to those skilled in the art, for example, by casting. Alternatively, sleeve 34 may be a sheath which is slipped over rigid member 32, such as by pressurized air, and then optionally secured to member 32, for example, by adhesive. Preferably, central sleeve 34 is made from a resilient or elastomeric material, such as polyurethane, urethane, EPDM (ethylene propylene diene monomer), or rubber and has a medium hardness, preferably 50–70 durometer Shore A or equivalent. The length of central sleeve 34 is less than the known distance between the knurls (if the margins of the web are knurled) or the known distance between the edgebeads (if the web is coated), whichever length is smaller.

End sleeves 36, 38 are contiguous with central sleeve 34. End sleeves 36, 38 are supported by member 32 and provide cylindrical surfaces having diameters substantially equal to that of the cylindrical surface of sleeve 34. The lengths of all three sleeves 34, 36, 38 are such that they form a continuous composite sleeve having a length greater than the width of the web being wound. The length of end sleeves 36, 38 are such that the knurled margins overlay an end sleeve (if the margins of the web are knurled) or the edgebeads overlay an end sleeve (if the web is coated), while, preferably, not overlaying central sleeve 34. The hardness of end sleeves 36, 38 is less than that of central sleeve 34, with a hardness preferably ranging between 20 and 30 durometer Shore A or equivalent. Suitable materials for end sleeves 36, 38 include polyurethane, urethane, EPDM, or rubber, with a suitable composite thickness of sleeves 34, 36, 38 being at least 0.25 inches (6.35 mm). Rotation means 40, 42 are attached at the ends of member 32 for providing rotation of pressure roller 30.

Figure 6:
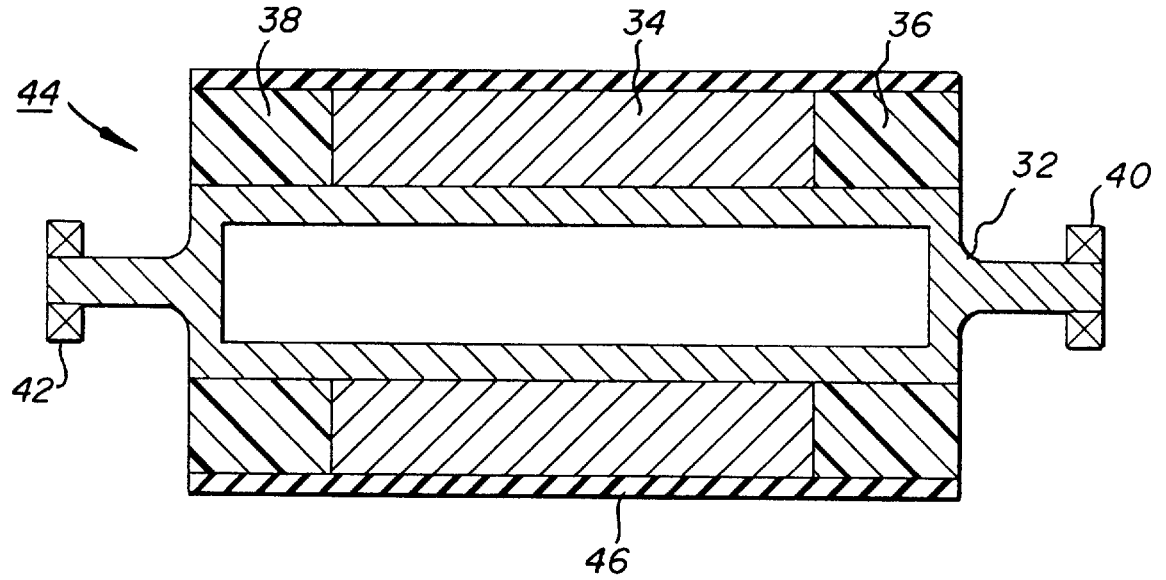
FIG. 6 shows a second embodiment of a pressure roller according to the present invention.

A second embodiment 44 of a pressure roller of the present invention is illustrated in FIG. 6, and includes member 32, central sleeve 34, end sleeves 36, 38, and rotation means 40, 42. Pressure roller 44 further includes an outer cylindrical cover 46 that overlays sleeves 34, 36, 38. Outer cover 46 is made of a material which is stiffer and harder than sleeves 34,36, 38, with a preferred hardness being about 80–90 durometer Shore A or greater. Suitable materials for outer cover 46 include polyurethane, urethane, EPDM, or rubber. A suitable thickness of cover 46 is less than about 0.125 inches (3.18 mm) and preferably not greater than about 0.0625 inches (1.59 mm). Such a cover provides wear resistance without affecting the compliance of the end sleeves. For ease of manufacturing, cover 46 has a substantially similar durometer throughout. However, cover 46 could be of multiple durometer, though preferably of harder durometer in the areas of greater wear.

Pressure rollers 30, 44 are suitable for the winding methods described above, while other methods of winding involving a nip may also be within the scope of the invention.

Figure 7A:
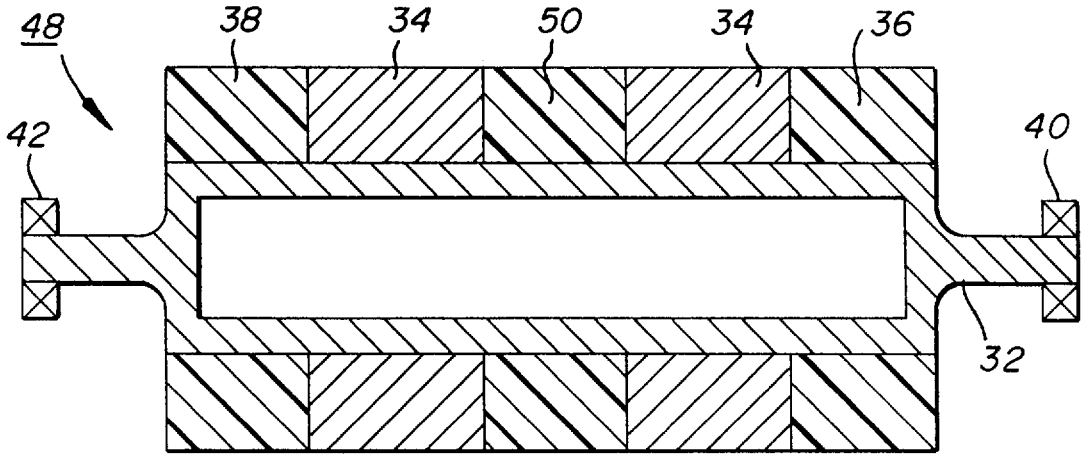
FIG. 7(*a*) shows a third embodiment of a pressure roller according to the present invention.
Figure 7B:
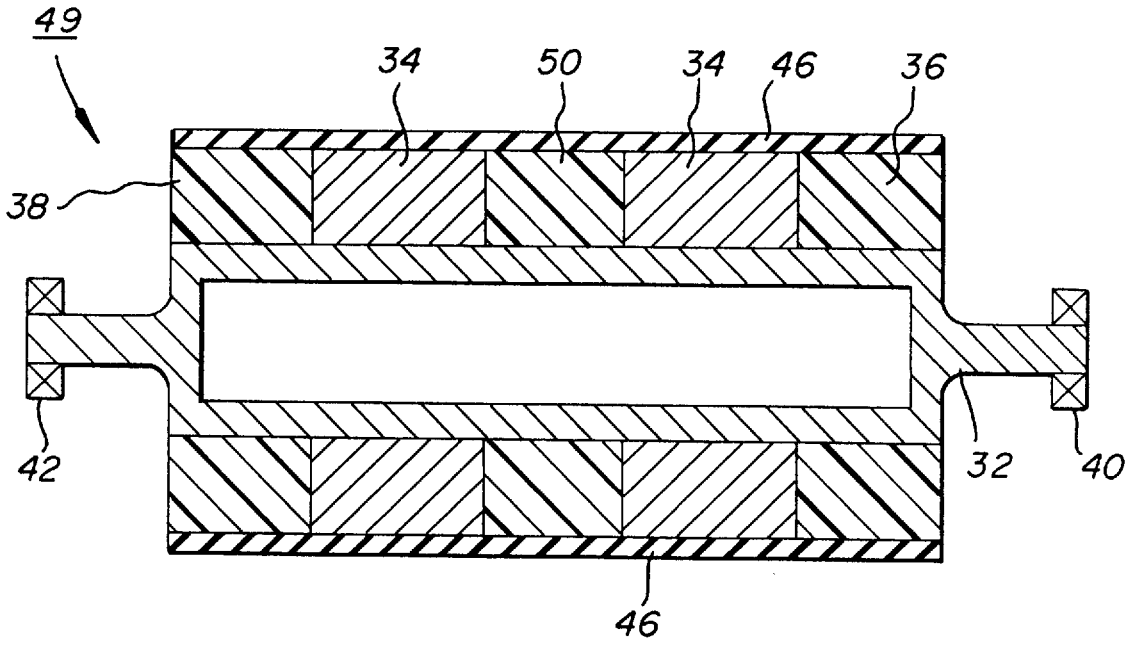

Also within the scope of the invention are pressure rollers 48, 49, illustrated in FIGS. 7(*a*) and 7(*b*), respectively, which accommodate web material having knurls, edgebeads, or hardstreaks in the central portion of the web as well as in the margins. As illustrated in FIG. 7(*a*), pressure roller 48 includes middle sleeve 50, made of similar material as end sleeves 36, 38, and having a hardness less than that of central sleeves 34. Pressure roller 49, illustrated in FIG. 7(*b*) further includes outer cover 46 that overlays the sleeves; outer cover 46 being made of a material which is stiffer and harder than the sleeves.

Figure 3:
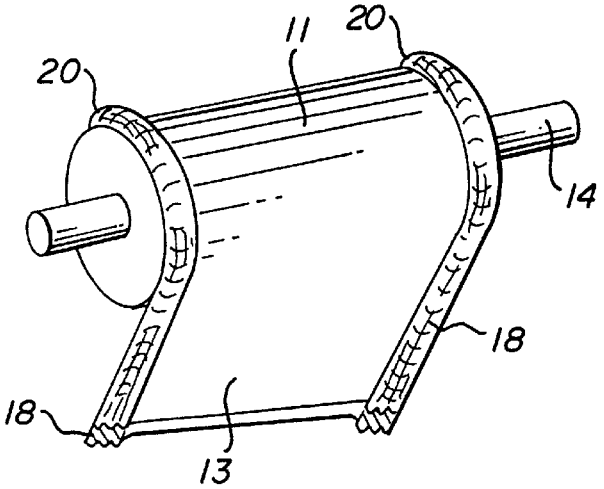
FIG. 3 PRIOR ART
FIG. 3 shows a sectional view of a roll of knurl-edged web forming a knurl tire.
Figure 4:
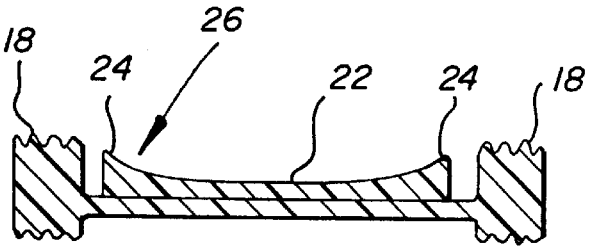
FIG. 4 PRIOR ART
FIG. 4 shows a sectional view of a web having knurled margins and a coating having edgebeads.
Figure 8:
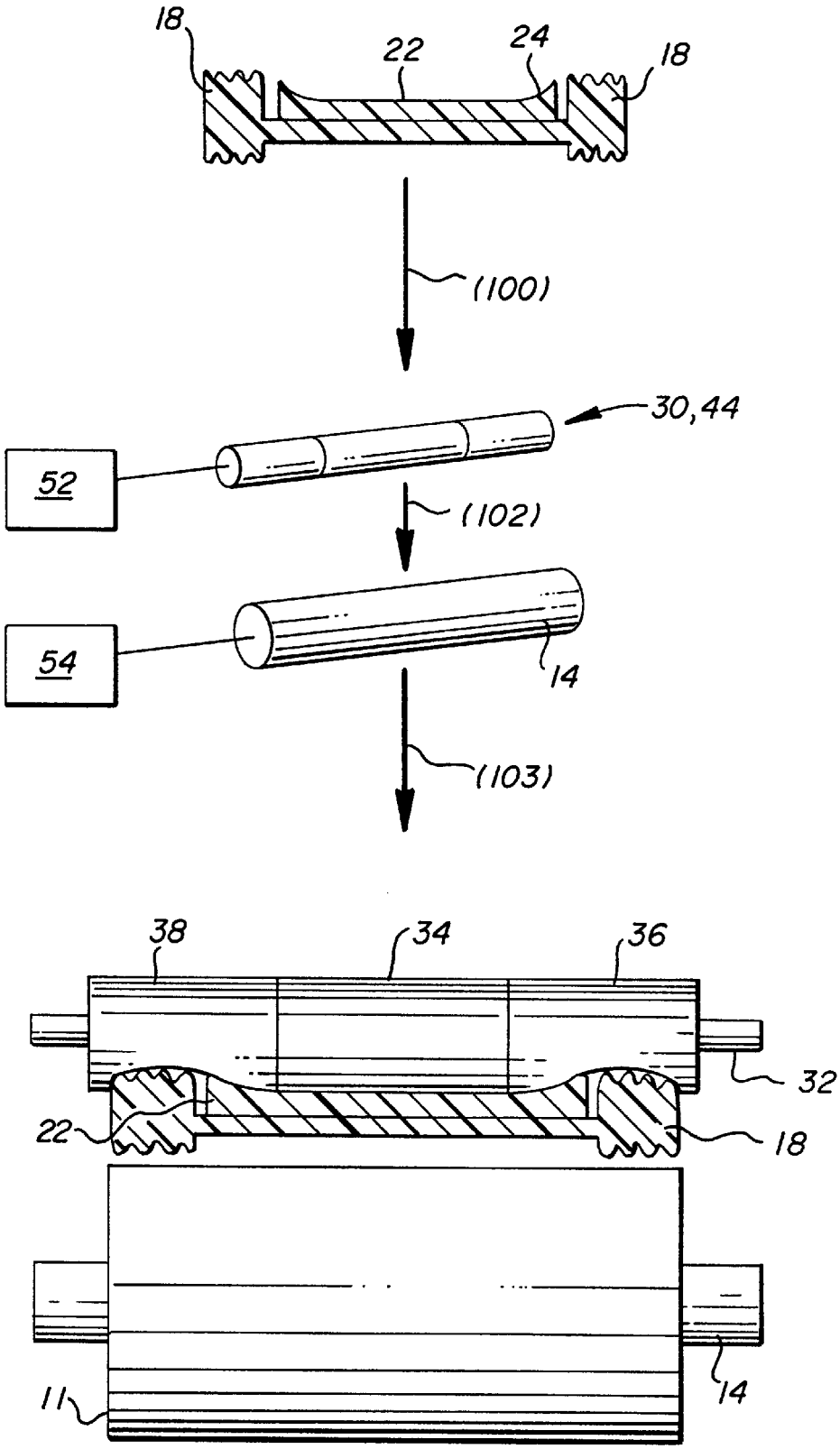
FIG. 8 illustrates a method of winding a web onto a core according to the present invention.

A pressure roller having a constant hardness may not provide contact throughout its length with the roll being wound, particularly with the center of the winding roll. For example, a pressure roller having a high constant hardness throughout its outer surface may contact a knurl tire, such as knurl tire 20 shown in FIG. 3, and, not being able to deform or bend, it may not contact the center of the wound web. With multiple durometer pressure rollers 30, 44, 48, 49 knurl tire 20 contacts the softer, compliant, low durometer end sleeves 36, 38, whereby the pressure roller complies to contact the winding roll across its width. As illustrated in FIG. 8, web 13 is positioned for transportation (100) through the nip (102) formed by core 14 and pressure roller 30, 44, 48, 49. The edges of web 13 are aligned to contact end sleeves 36,38 when being transported through the nip (103). Rotation means 52,54 are provided to rotate the pressure roller and core, respectively. As web 13 with features (e.g., knurl tires, hardstreaks, and edgebeads) is wound onto core 14, web 13 comes in contact with pressure roller 30, 44, 48, 49. End sleeves 36,38 deform (i.e., comply, bend) to conform to the features of web 13, allowing resilient sleeve 34 to maintain contact with web 13 of roll 11. Pressure can be applied along the entire length of either the pressure roller or the core. A slidable mount or a pivotable mount for supporting the pressure roller can be used to provide a constant pressure at the nip (FIGS. 12(*a*) and 12(*b*). Alternatively, a slidable mount or a pivotable mount can be used to support the core at the nip to provide a constant pressure at the nip (FIGS. 12(*c*) and 12(*d*). In a preferred embodiment, web 13 is wrapped around core 14 for up to 300 degrees before web 13 is transported through nip 12.

A suitable pressure roller configuration may be dependent on the end use, thus, optimizations can be made accordingly. For example, in one manufacturing setting, knurl tires may be large, particularly when the center of the web is thin relative to the knurled margins. Thus, the pressure roller should be able to largely deform to maintain contact with the web. In contrast, for coated webs the knurl tires may be lower, the coating being nearly the same thickness as the knurls, so the presence of edgebeads is a critical factor. The following discussion illustrates the use of multiple durometer pressure rollers in web winding applications.

EXAMPLE 1

An analytical model provides a comparison of three different pressure rollers for winding knurled web material. For each pressure roller, the amount of contact force is 50 pounds (222N) over an approximately 50 inch (1.27 m) wide web material. A maximum knurl tire height of 0.06 inches (1.524 mm) is expected at the winder. Each pressure roller consists of a hollow aluminum core with an outer diameter of 5.25 inches (133.35 mm) and an inner diameter of 4.75 inches (120.65 mm). Referring to Table 1, Case 1 represents a pressure roller covered by a single 50 Shore A durometer elastomer, 0.5 inches (12.7 mm) thick, with no outer cover layer. Case 2 represents a pressure roller according to the first embodiment covered with a 50 Shore A durometer elastomer in the central section and a 25 Shore A durometer elastomer at each end, each section having a thickness of 0.5 inches (12.7 mm). Case 3, the second embodiment of the present invention, represents a pressure roller of Case 2 with the elastomers being 0.437 inches (11.11 mm) thick and covered by an outer cover of a 90 Shore A durometer elastomer having a thickness of 0.0625 inches (1.59 mm).

Table 1 illustrates the results for each case. "Deflection" indicates the amount of deflection between the centerline of the pressure roller and between the centerline of the core. "Knurl Strain" is the average circumferential strain in the elastomer in contact with the knurl; and "Max Deflection" is the maximum amount of knurl tire, hardstreak, or edgebead tire that the pressure roller can accommodate and still maintain contact with the center of the winding roll. In Case 1, a 0.007 inch (0.178 mm) gap is detected between the center of the roller and the center of the wound roll, indicating a lack of contact between the pressure roller and winding roll at the center. In Case 2, contact occurs across the surface of the winding roll, however, the strain in the knurl tire is 22% higher, indicating higher wear. This pressure roller of Case 2 is suitable for providing center contact in the presence of a knurl tire as high as 0.10 inches (2.54 mm), represented by the Maximum Deflection column in Table 1. However, the multiple durometer pressure roller according to the second embodiment of the present invention does not indicate high wear and provides surface contact at the center of the winding roll. Referring to Table 1, the strain in the knurl tire for Case 3 represents a 70% decrease in strain from the single durometer pressure roller of Case 1, and a 76% decrease in the strain from the dual durometer pressure roller of Case 2. The maximum predicted deflection at the ends is 0.0698 inches (1.77 mm) which is 30% less than Case 2, but suitable for this application.

TABLE 1

| Case | Deflection | Knurl Strain | Max. Deflection |
|---|---|---|---|
| 1. Single Durometer (50 throughout) | 0.053 in (1.34 mm) | 0.0633 | — |
| 2. Dual Durometer (50 center, 25 ends) | 0.066 in (1.69 mm) | 0.0775 | 0.1000 in (2.54 mm) |
| 3. Tri-Durometer (50 center, 25 ends, 90 skin) | 0.063 in (1.60 mm) | 0.0188 | 0.0698 in (1.77 mm) |

EXAMPLE 2

An analytical model provides a comparison of three different pressure rollers for winding web material with knurls. For each pressure roller, the amount of contact force is about 50 pounds (222 N) over an approximately 50 inch wide web material. A maximum knurl tire height of 0.120 (3.05 mm) inches is expected at the winder. Each pressure roller consists of a hollow aluminum core with an outer diameter of 5.25 inches (133.35 mm) and an inner diameter of 4.75 inches (120.65 mm). Case 1 represents a pressure roller covered by a single 50 Shore A durometer elastomer, 0.5 inches (12.7 mm) thick, with no outer cover layer. Case 2 represents a pressure roller covered with a 50 Shore A durometer elastomer in the central section and a 20 Shore A durometer elastomer at each end, each section having a thickness of 0.75 inches (19.05 mm). Case 3, the second embodiment of the present invention, represents a pressure roller of Case 2 with the elastomers being 0.75 inches (19.05 mm) thick and covered by an outer cover of a 90 Shore A durometer elastomer having a thickness of 0.0625 inches (1.59 mm).

Table 2 illustrates the results for each case. The single durometer pressure roller of Case 1 is noted as providing a 0.047 inch (1.19 mm) gap between the center of the pressure roller and the center of the winding roll. In Case 2, the pressure roller can maintain center contact in the presence of a knurl tire up to 0.133 inches high, but the strain in the knurl tire increases by 79% from Case 1, indicating much higher wear. The multiple durometer pressure roller of Case 3, the pressure roller of the second embodiment of the present invention, allows contact and reduced strain. The strain in the knurl tire for Case 3 represents a 36% decrease in strain from the single durometer pressure roller of Case 1, and a 64% decrease in strain from the dual durometer pressure roller of Case 2. The highest knurl tire that can be accommodated by the pressure roller of Case 3 is 0.123 (3.12 mm).

TABLE 2

| Case | Deflection | Knurl Strain | Max. Deflection |
|---|---|---|---|
| 1. Single Durometer (50 throughout) | 0.073 in (1.85 mm) | 0.0553 | — |
| 2. Dual Durometer (50 center, 20 ends) | 0.123 in (3.12 mm) | 0.0992 | 0.133 in (3.38 mm) |
| 3. Tri-Durometer (50 center, 20 ends, 90 skin) | 0.121 in (3.07 mm) | 0.0353 | 0.123 in (3.12 mm) |

If knurls are not present, perforations and slit edges can similarly affect the winding operation. For example, if slitting and perforating are not made with sharp equipment, slitting and perforation edges can be slightly thicker than the rest of the web; a build up of a tire similar to that formed by a knurl can result.

EXAMPLE 3

Figure 9:
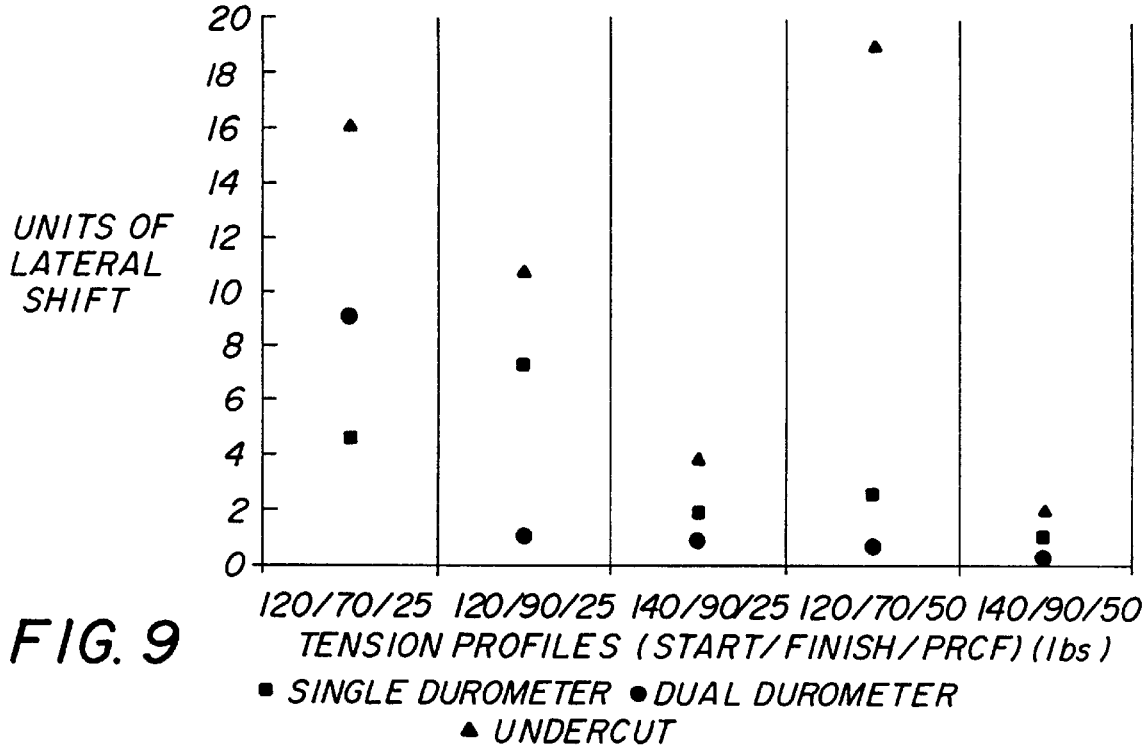
FIG. 9 shows a comparison of lateral shift versus tension profiles using different pressure rollers.
Figure 10:
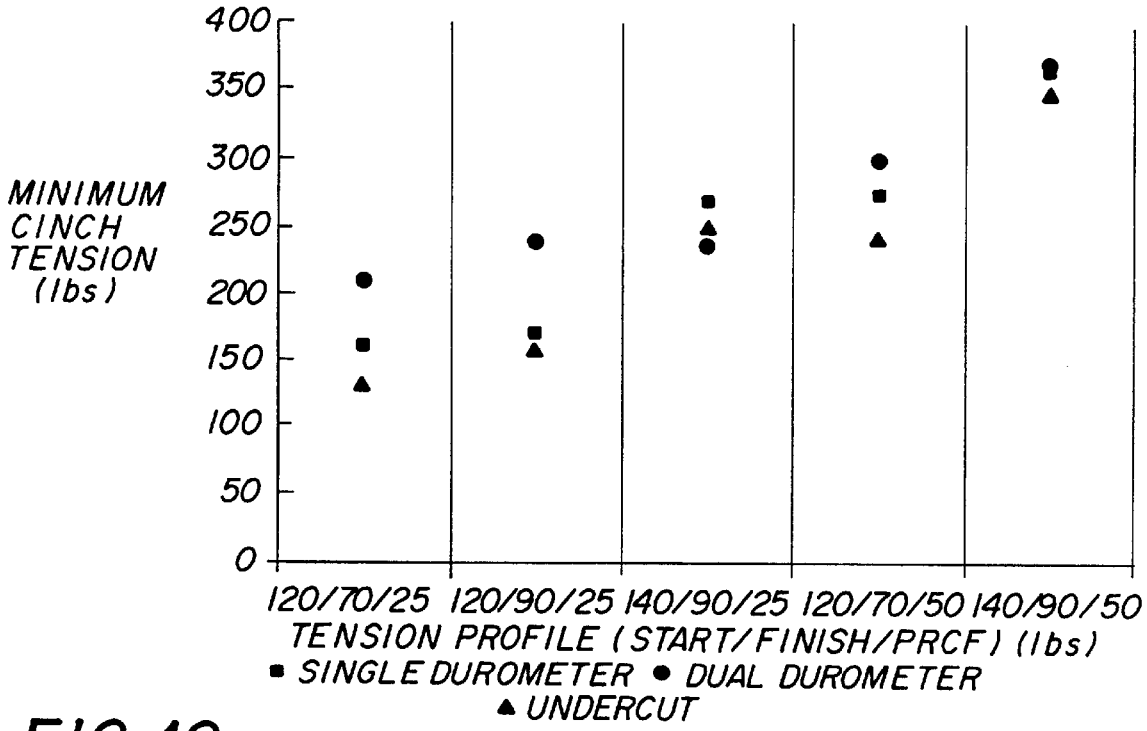
FIG. 10 shows a comparison of minimum cinch tension versus tension profiles for different pressure roller types.
Figure 11:
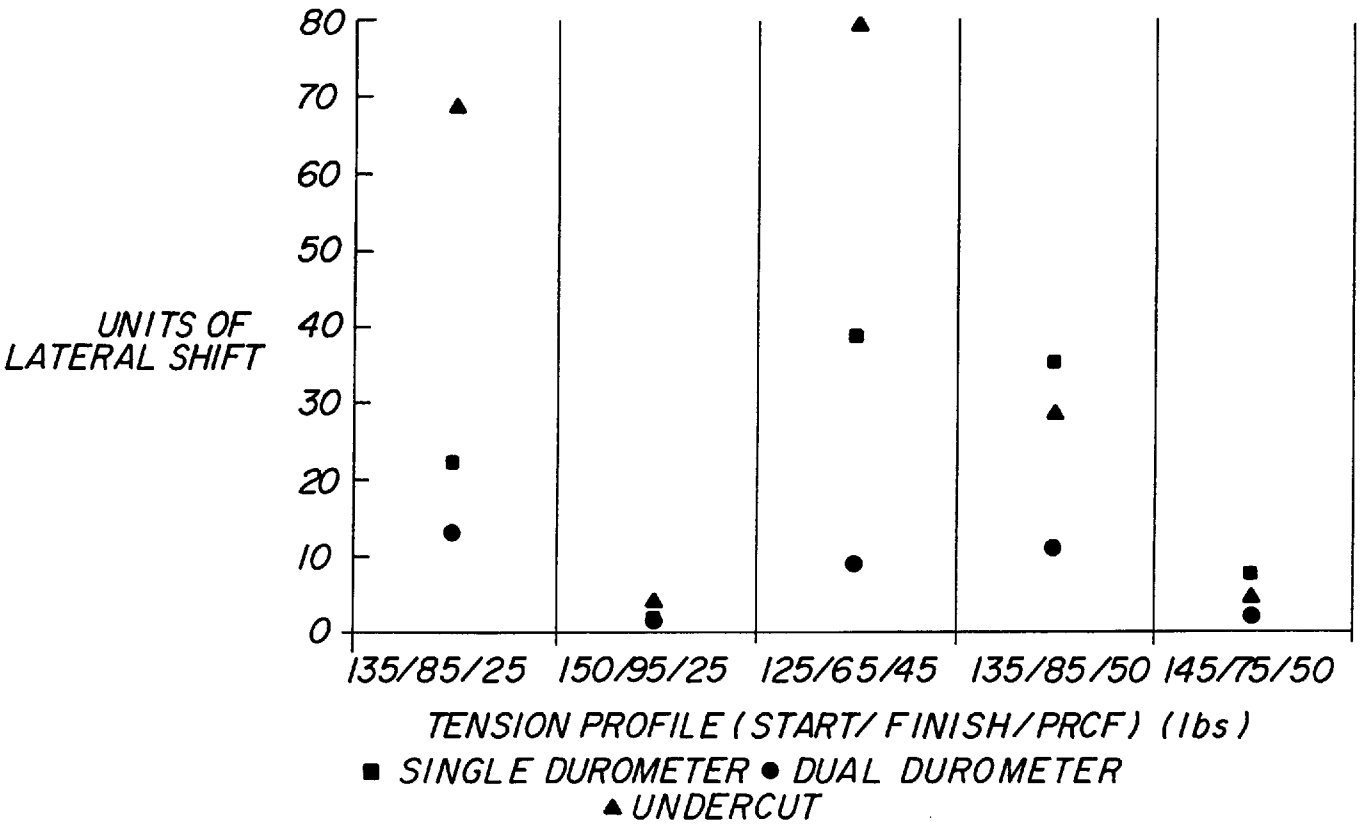
FIG. 11 shows a comparison of lateral shift versus tension profiles for different pressure roller types, wherein the coated web has imbalanced edgebeads.
Figure 12A:
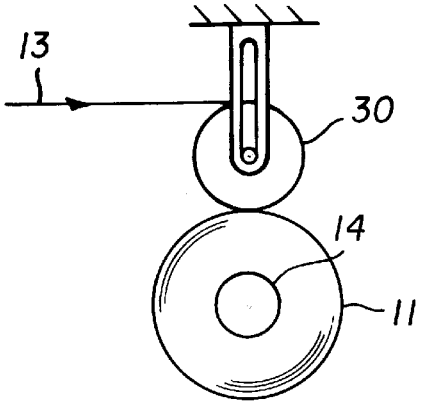
FIGS. 12(*a*)–12(*d*) show slidable and pivotable mounts for supporting the pressure roller or core to provide pressure at the nip.
Figure 12B:
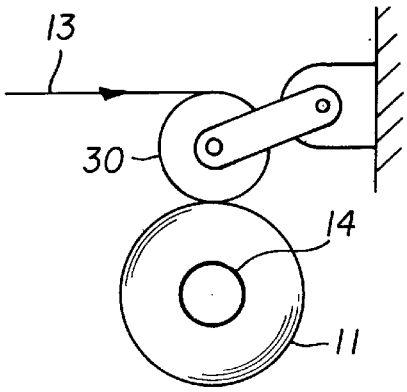
Figure 12C:
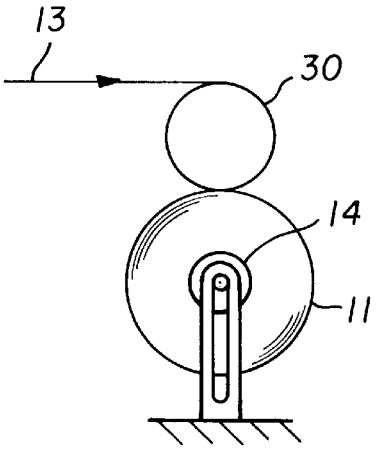
Figure 12D:
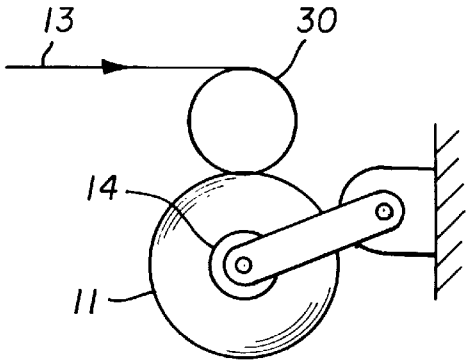

FIGS. 9 through 11 provide experimental data illustrating improvements in axial shifting and cinching obtained using a pressure roller according to the present invention. Three different pressure rollers are compared at various tensions and pressure roller contact forces. A single durometer pressure roller that is shorter than the distance between knurls, referred to as Undercut, and having a hardness of about 70 durometer, is compared to a standard single durometer pressure roller (illustrated in the figures as a Single Durometer) having a hardness of about 45 durometer and a dual durometer pressure roller (illustrated in the figures as a Dual Durometer) having a hardness of 50 at the center and 30 at the ends.

FIG. 9 illustrates the amount of lateral shift in the direction of the core axis versus the tension profile. A 6000 ft. roll of coated, knurled web material was wound at various winding conditions with each of the three pressure rollers. As illustrated, generally the amount of shifting was less with the Dual Durometer pressure roller. The tension profiles indicate the starting tension, finishing tension, and pressure roller contact force (essentially the total force applied to the nip by the pressure roller), all in units of pounds.

After winding, each roll was raised to a higher tension until cinching occurred. FIG. 10 shows the minimum cinch tension versus the tension profiles for the three pressure rollers. As illustrated, generally the Dual Durometer pressure roller required more tension for cinching to occur, that is, more torque was required to cinch than the other rollers, a desired feature in web winding.

A similar experiment was performed with a 10,000 ft. roll of coated web material wherein one side of the web had a high simulated edgebead, and the other side had no edgebead (referred to as imbalanced edgebeads). The results of the experiment, illustrated in FIG. 11, show the lateral shift versus tension profile. Less axial shifting occurred with the Dual Durometer pressure roller.

A multiple durometer pressure roller allows for winding rolls of deformable material having knurls and/or edgebeads. With such a pressure roller, pressure can be applied across the width of the winding roll. Better roll quality and stability is achieved, that is, less shifting and cinching are apparent in rolls wound with the pressure roller of the present invention. Further, better roll quality and stability is achieved when knurls and/or edgebeads are imbalanced side-to-side on the roll. Such pressure rollers can be optimized for various manufacturing situations. In addition, rolls can be wound at high speeds. The present invention also reduces or eliminates the need for flanges at the ends of the winding rolls (the flanges being present to prevent shifting off of the core), thus reducing the possibility of edge nicks.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

Parts List

10 pressure roller
11 winding roll
12 nip
13 web material
14 core
16 gage band
18 knurl
20 knurl tire
22 coating
24 coated margins
26 coating edgebead
30 pressure roller; first embodiment
32 rigid member
34 resilient sleeve
36 end sleeve
38 end sleeve
40, 42 means for rotation
44 pressure roller; second embodiment
46 outer cover
48 pressure roller; a third embodiment
49 pressure roller; a fourth embodiment
50 middle sleeve
52,54 rotation means

What is claimed is:

1. An apparatus for winding a web of deformable material comprising a core forming a nip with a pressure roller wherein the web passes through the nip as it is wound onto the core, the pressure roller including:

a rigid cylindrical shaft having a first and second end;

a central resilient sleeve having two ends and coaxially supported on the rigid shaft, the resilient sleeve having a cylindrical surface;

a first end sleeve coaxially supported on the first end of the rigid shaft, the first end sleeve being contiguous with one end of the resilient sleeve and having a diameter substantially equal to that of the cylindrical surface; and a second end sleeve coaxially supported on the second end of the rigid shaft, the second end sleeve being contiguous with the other end of the resilient sleeve and having a diameter substantially equal to that of the cylindrical surface wherein the first and second end sleeves have a durometer less than a durometer of the resilient sleeve.

2. The apparatus according to claim 1 further comprising means for rotating the rigid cylindrical shaft.

3. The apparatus according to claim 1 further comprising means for rotating the core.

4. The apparatus according to claim 1 further comprising a slidable mount supporting the pressure roller to provide a constant pressure at the nip.

5. The apparatus according to claim 1 further comprising a pivotable mount supporting the pressure roller to provide a constant pressure at the nip.

6. The apparatus according to claim 1 further comprising a slidable mount supporting the core to provide a constant pressure at the nip.

7. The apparatus according to claim 1 further comprising a slidable mount supporting the core to provide a constant pressure at the nip.

8. The apparatus according to claim 1 wherein the central resilient sleeve is made of an elastomer having a durometer of 50–55 Shore A, and the end sleeves are made of an elastomer having a durometer of 20–30 Shore A.

9. The apparatus according to claim 1 further comprising an outer cover covering the resilient sleeve and the first and second end sleeves, and having a durometer greater than the durometer of the resilient sleeve and first and second end sleeves.

10. The apparatus according to claim 9 wherein said central resilient sleeve is comprised of an elastomer having a durometer of 50–55 Shore A, said end sleeves are comprised of an elastomer having a durometer of 20–30 Shore A, and said outer cover is comprised of an elastomer having a durometer of 80–90 Shore A.

11. An apparatus for winding a web of deformable material having a widthwise thickness variation, the apparatus comprising a core forming a nip with a pressure roller wherein the web passes through the nip as it is wound onto the core, the pressure roller including:

a rigid cylindrical shaft having a first and second end;

a central resilient sleeve having two ends and coaxially supported on the rigid shaft, the resilient sleeve having a cylindrical surface;

a first end sleeve coaxially supported on the first end of the rigid shaft, the first end sleeve being contiguous with one end of the resilient sleeve and having a diameter substantially equal to that of the cylindrical surface; and a second end sleeve coaxially supported on the second end of the rigid shaft, the second end sleeve being contiguous with the other end of the resilient sleeve and having a diameter substantially equal to that of the cylindrical surface wherein the first and second end sleeves have a durometer less than a durometer of the resilient sleeve.

* * * * *

UNITED STATES PATENT AND TRADEMARK OFFICE

CERTIFICATE OF CORRECTION

PATENT NO. : 5,803,398
DATED : Sep. 8, 1998
INVENTOR(S) : Yoshito Hashikawa

It is certified that error appears in the above-identified patent and that said Letters Patent is hereby corrected as shown below:

Title page, insert the following item:
--[60] Provisional Application No. 60/003,346, Sep. 7, 1995.--

Column 1, line 2, insert the following:
--CROSS REFERENCE TO RELATED APPLICATION
Reference is made to and priority claimed from U.S. Provisional Application Ser. No. 60/003,346, filed Sep. 7, 1995, entitled MULTIPLE DUROMETER PRESSURE ROLLER.--.

Signed and Sealed this
Twenty-third Day of February, 1999

*Attest:*

Q. TODD DICKINSON

*Attesting Officer*

*Acting Commissioner of Patents and Trademarks*